US010125473B2

(12) United States Patent
Nakagawa et al.

(10) Patent No.: US 10,125,473 B2
(45) Date of Patent: Nov. 13, 2018

(54) BULLDOZER

(71) Applicant: KOMATSU LTD., Tokyo (JP)

(72) Inventors: Yuta Nakagawa, Hirakata (JP); Kazuyuki Suzuki, Hirakata (JP); Souichi Tsumura, Hirakata (JP)

(73) Assignee: KOMATSU LTD., Tokyo (JP)

( * ) Notice: Subject to any disclaimer, the term of this patent is extended or adjusted under 35 U.S.C. 154(b) by 162 days.

(21) Appl. No.: 15/117,764

(22) PCT Filed: Feb. 17, 2016

(86) PCT No.: PCT/JP2016/054554
§ 371 (c)(1),
(2) Date: Aug. 10, 2016

(87) PCT Pub. No.: WO2017/141373
PCT Pub. Date: Aug. 24, 2017

(65) Prior Publication Data
US 2018/0066412 A1 Mar. 8, 2018

(51) Int. Cl.

| | |
|---|---|
| ***B60N 99/00*** | (2006.01) |
| ***E02F 9/08*** | (2006.01) |
| ***E02F 9/16*** | (2006.01) |
| ***E02F 3/76*** | (2006.01) |

(52) U.S. Cl.
CPC ..... *E02F 9/0833* (2013.01); *E02F 3/76* (2013.01); *E02F 9/16* (2013.01)

(58) Field of Classification Search
CPC ..... E02F 9/0833; E02F 9/16
See application file for complete search history.

(56) References Cited

U.S. PATENT DOCUMENTS

| | | | | |
|---|---|---|---|---|
| 9,828,049 | B2 * | 11/2017 | Lyle | E02F 9/121 |
| 2005/0189125 | A1 | 9/2005 | Matsumoto et al. | |
| 2014/0048352 | A1 | 2/2014 | Takenawa et al. | |
| 2014/0191537 | A1 | 7/2014 | Bilbruck et al. | |
| 2015/0159349 | A1 | 6/2015 | Horton | |

FOREIGN PATENT DOCUMENTS

| | | | |
|---|---|---|---|
| JP | 2005-171751 | A | 6/2005 |
| JP | 2013-053520 | A | 3/2013 |
| JP | 2013-087416 | A | 5/2013 |

OTHER PUBLICATIONS

Hiroshi Nakagami, et al., "Introduction of Products, Introduction of Bulldozers D155AX-8/AXi-8," Komatsu Technical Report, vol. 60 No. 167, Komatsu Ltd., [Online] Mar. 27, 2015, pp. 39-45, <http://www.komatsu.co.jp/CompanyInfo/profile/report/pdf/167-J06.odf>, <http://www.komatsu.co.jp/CompanyInfo/profile/report/>, including English language translation.

* cited by examiner

*Primary Examiner* — Lori L Lyjak
(74) *Attorney, Agent, or Firm* — Drinker Biddle & Reath LLP

(57) ABSTRACT

Provided is a bulldozer enabling the visibility of a rearward area of the bulldozer's body to be improved. The bulldozer includes a cab for an operator to be aboard, a fuel tank disposed rearward of the cab, and a work platform serving as a scaffold for an operator. A notch is formed at a front edge of the work platform.

4 Claims, 5 Drawing Sheets

BULLDOZER

TECHNICAL FIELD

The present invention relates to a bulldozer.

BACKGROUND ART

A bulldozer equipped with a blade disposed frontward of a bulldozer's body and a ripper device disposed rearward of the bulldozer's body and used for excavating hard earth and soft stone has been proposed (see for example Japanese Patent Laying-Open No. 2005-171751 (PTD 1)).

CITATION LIST

Patent Document

PTD 1: Japanese Patent Laying-Open No. 2005-171751

SUMMARY OF INVENTION

Technical Problem

A large-sized bulldozer may be equipped with a work platform which is placed above a fuel tank for work such as maintenance and cleaning performed behind a cab. In the case where the work platform is placed and an operator aboard the cab is to see rearward of the bulldozer's body, there is a possibility that the operator's field of view is blocked by the work platform and the rearward visibility is deteriorated.

An object of the present invention is to provide a bulldozer enabling the visibility of a rearward area of the bulldozer's body to be improved.

Solution to Problem

A bulldozer of the present invention includes a cab for an operator to be aboard, a fuel tank disposed rearward of the cab, and a work platform serving as a scaffold for an operator. The work platform is disposed above the fuel tank. A notch is formed at a front edge of the work platform.

The bulldozer of the present invention enables an operator aboard the cab to see a rearward area of the bulldozer through the notch. Since the situation where the field of view of an operator aboard the cab is blocked by the work platform can be avoided, the visibility of a rearward area of the bulldozer can be improved.

The bulldozer further includes a handrail disposed above the notch. Accordingly, a service person can hold the handrail to make the service person's posture stable, and therefore the work efficiency can be improved.

In the bulldozer, a part of the fuel tank is recessed from an upper surface to a rear surface of the fuel tank to form a recess. The recess and the notch overlap each other as seen in plan view. Accordingly, an operator aboard the cab can visually recognize a broader range through the recess and the notch.

The bulldozer further includes a ripper device disposed rearward of the fuel tank. Accordingly, an operator aboard the cab can visually recognize a ripping tip of the ripper device through the notch.

The bulldozer further includes a vehicular body frame on which the cab is mounted. The work platform is fixed to the vehicular body frame. Accordingly, the work platform can be implemented as a stabler structure, and the work efficiency on the work platform can further be improved.

Advantageous Effects of Invention

The bulldozer of the present invention enables the visibility of a rearward area of the bulldozer's body to be improved.

DESCRIPTION OF EMBODIMENTS

In the following, embodiments of the present invention will be described based on the drawings.

Initially, a description will be given of a configuration of a bulldozer to which the concept of the present invention is applicable.

Figure 1:
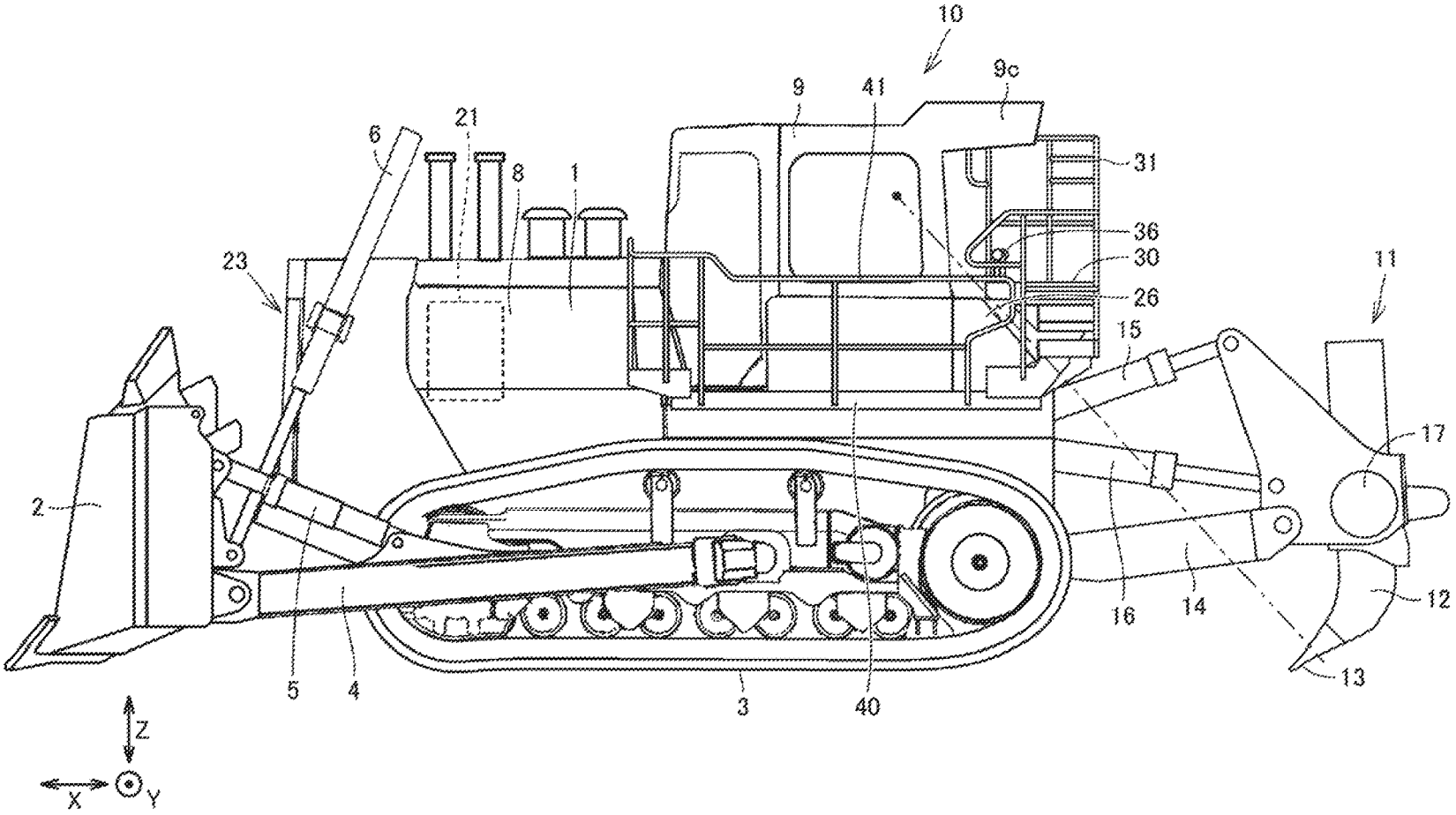
FIG. 1 is a side view schematically showing a configuration of a bulldozer in one embodiment of the present invention.
Figure 2:
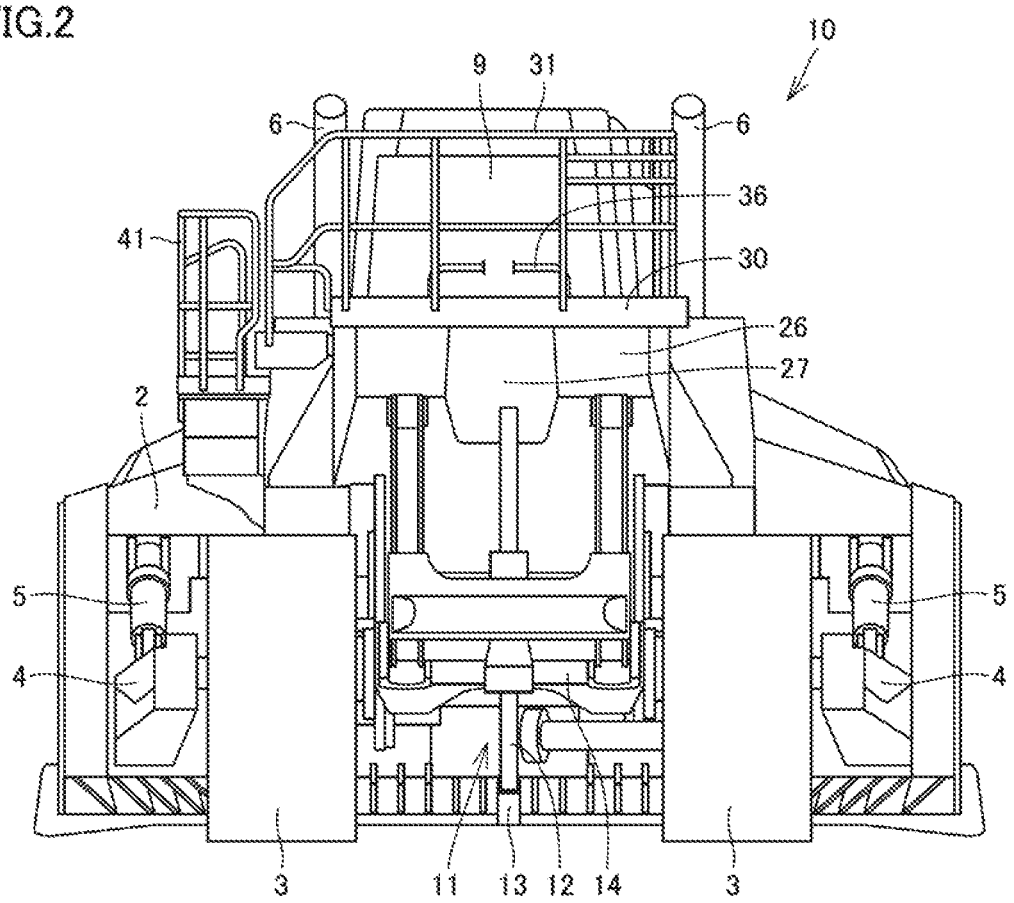
FIG. 2 is a back view of the bulldozer shown in FIG. 1.
Figure 3:
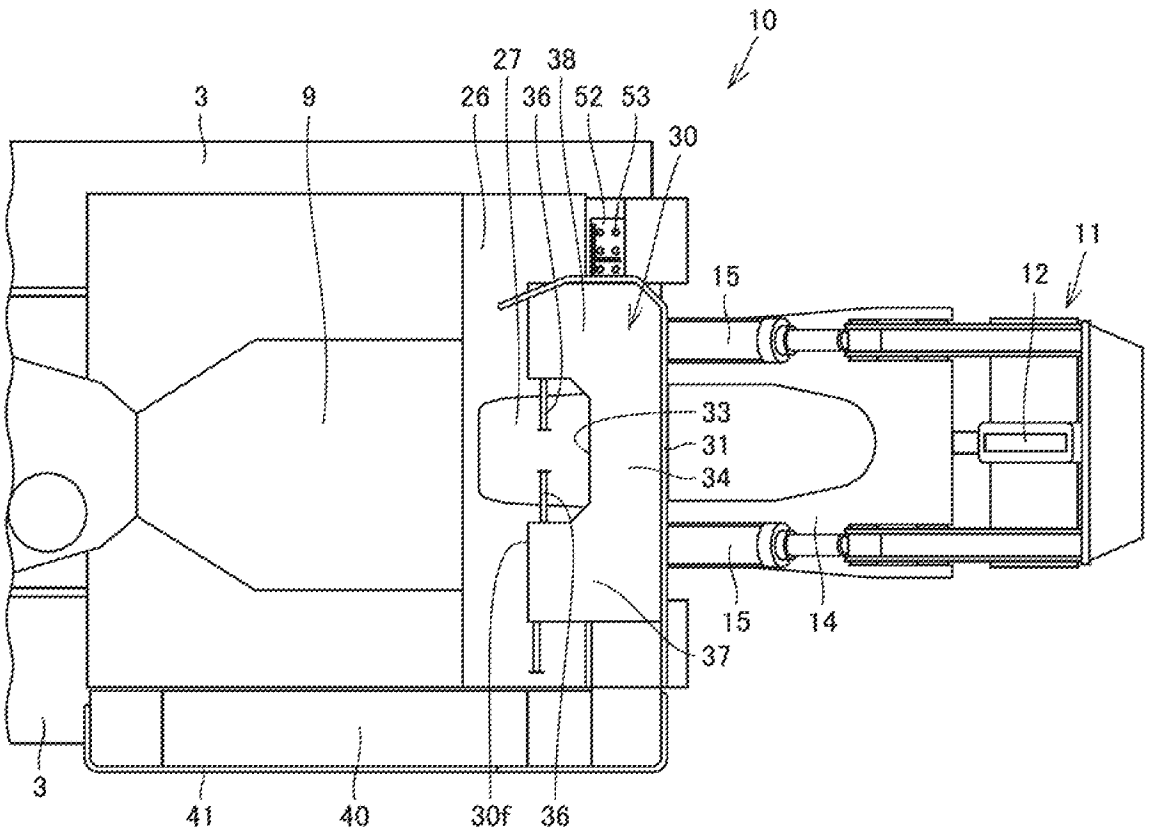
FIG. 3 is a plan view showing a part of the configuration of the bulldozer shown in FIG. 1.

FIG. 1 is a side view schematically showing a configuration of a bulldozer 10 in one embodiment of the present invention. FIG. 2 is a back view of bulldozer 10 shown in FIG. 1. FIG. 3 is a plan view showing a part of the configuration of bulldozer 10 shown in FIG. 1. As shown in FIGS. 1 to 3, bulldozer 10 of the present embodiment mainly includes a vehicular body 1, a blade 2, and a traveling device. The traveling device has a pair of right and left crawler type carriers 3 separated from each other in the vehicular width direction. Vehicular body 1 is disposed between the paired right and left crawler type carriers 3. Blade 2 is disposed at a frontward position of vehicular body 1.

Vehicular body 1 has a cab (operator's cab) 9 and an engine compartment 8. Cab 9 is disposed in an upper rear portion of vehicular body 1. Engine compartment 8 is disposed frontward of cab 9. Engine compartment 8 is disposed between cab 9 and blade 2. In engine compartment 8, an engine 21 is housed. An operator operating bulldozer 10 is aboard cab 9. Cab 9 has, in its inside, an operator's seat for an operator to sit, and is configured to surround the operator's seat.

In the present embodiment, the direction in which bulldozer 10 travels straight forward is referred to as front-rear direction of bulldozer 10. In the front-rear direction of bulldozer 10, the direction in which blade 2 protrudes from vehicular body 1 is referred to as frontward direction. In the front-rear direction of bulldozer 10, the direction opposite to the frontward direction is referred to as rearward direction. The right-left direction of bulldozer 10 is the direction orthogonal to the front-rear direction as seen in plan view. From the viewpoint in the frontward direction, the right side and the left side in the right-left direction are respectively rightward direction and leftward direction. The top-bottom direction of bulldozer 10 is the direction orthogonal to a plane defined by the front-rear direction and the right-left direction. In the top-bottom direction, the ground side is lower side and the sky side is upper side.

The front-rear direction is the front-rear direction with respect to an operator sitting on the operator's seat in cab 9. The right-left direction is the right-left direction with respect to an operator sitting on the operator's seat. The right-left direction is the vehicular width direction of bulldozer 10. The top-bottom direction is the top-bottom direction with respect to an operator sitting on the operator's seat. The direction in which an operator sitting on the operator's seat faces is the frontward direction, and the backward direction with respect to an operator sitting on the operator's seat is the rearward direction. The right side and the left side with respect to an operator sitting on the operator's seat and facing frontward are respectively the rightward direction and the leftward direction. The feet side and the head side of an operator sitting on the operator's seat are respectively the lower side and the upper side.

In the following drawings, the front-rear direction is indicated by an arrow X, the right-left direction is indicated by an arrow Y, and the top-bottom direction is indicated by an arrow Z.

To the top end of the rear surface of cab 9, a condenser housing 9*c* is attached. Condenser housing 9*c* protrudes rearward from cab 9. Condenser housing 9*c* houses a condenser for air conditioning. In the plan view shown in FIG. 3, condenser housing 9*c* is not shown for the sake of clarifying the illustration.

Bulldozer 10 includes blade 2 located frontward as a work implement. Blade 2 is a work implement for performing work such as excavation of earth and sand and grading. Blade 2 is supported at each of its right side and left side by a frame 4. Frame 4 is a member in the shape of a quadrangular prism. One end of frame 4 is attached to the back surface of blade 2 by a rotatable support. The other end of frame 4 is supported on a side surface of the traveling device.

Blade 2 is actuated by tilt cylinders 5 and lift cylinders 6. One end of tilt cylinder 5 is supported on the back surface of blade 2. The other end of tilt cylinder 5 is supported on the upper surface of frame 4. Tilt cylinder 5 is extended/contracted by a hydraulic pressure to cause the top end of blade 2 to move in the front-rear direction about the support with which frame 4 is attached to blade 2. Accordingly, the tilt angle of blade 2 is changed.

One end of lift cylinder 6 is supported on the back surface of blade 2. An intermediate portion of lift cylinder 6 is supported on a side surface of vehicular body 1. Lift cylinder 6 is extended/contracted by a hydraulic pressure to cause blade 2 to move in the top-bottom direction about the other end of frame 4.

A front grille 23 is attached to vehicular body 1. Front grille 23 is disposed at the front end of vehicular body 1. Front grille 23 is disposed to cover an opening formed at the front end of vehicular body 1. Blade 2 is disposed frontward of and spaced from front grille 23.

At the rear end of vehicular body 1, a fuel tank 26 is disposed. Fuel tank 26 is disposed rearward of cab 9. In fuel tank 26, fuel to be supplied to engine 21 is stored.

As shown in FIG. 1, the height of fuel tank 26 decreases toward the rear end as seen in side view. Fuel tank 26 has a taper surface inclining downward toward the rear end. At a substantially central portion in the right-left direction of fuel tank 26, a recess 27 is formed. A part of fuel tank 26 is recessed from the upper surface to the rear surface of fuel tank 26 to thereby form recess 27.

Bulldozer 10 includes a ripper device 11 as another work implement located rearward of vehicular body 1. Ripper device 11 is a work implement for ripping through and thereby breaking a hard material such as rock. The direction in which ripper device 11 protrudes from vehicular body 1 in the front-rear direction of bulldozer 10 is the rearward direction. Ripper device 11 is disposed rearward of and spaced from fuel tank 26.

Ripper device 11 has a shank 12. At the bottom end of shank 12, a ripping tip 13 is provided. Ripping tip 13 of ripper device 11 is thrust into a rock or the like to cut or break the rock by means of a traction force applied by the traveling device. Ripper device 11 is actuated by tilt cylinders 15 and lift cylinders 16.

A ripper arm 14 is provided below tilt cylinders 15 and lift cylinders 16. One end of ripper arm 14 is pivotably attached to vehicular body 1. To the other end of ripper arm 14, a beam 17 is attached pivotably with respect to ripper arm 14. Shank 12 is provided pivotably about beam 17, with respect to ripper arm 14.

Figure 4:
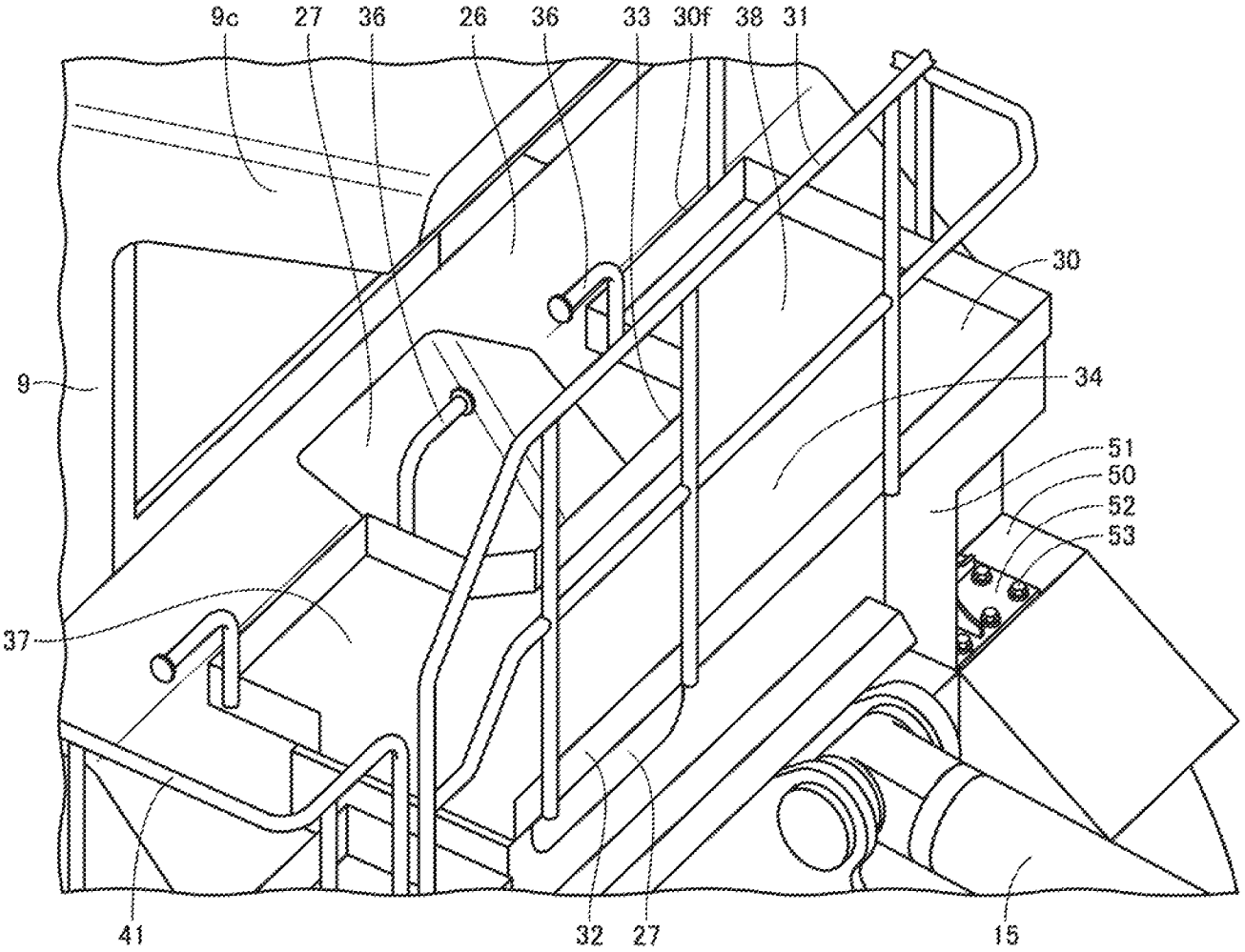
FIG. 4 is a perspective view showing a work platform and its surrounding region in an enlarged form.

A work platform 30 is disposed above fuel tank 26. FIG. 4 is a perspective view showing work platform 30 and its surrounding region in an enlarged form. As shown in FIGS. 1 to 3 and FIG. 4, work platform 30 is disposed rearward of cab 9. Work platform 30 is a scaffold for an operator to perform work behind cab 9. The works performed by an operator on work platform 30 are for example cleaning of a window of cab 9, replacing a filter and maintaining a breather of fuel tank 26, and cleaning of the condenser housed in condenser housing 9*c*, and the like.

To the rear edge of work platform 30, a guardrail 31 is attached for preventing unexpected fall. To the edge of work platform 30, a baseboard 32 is attached. The floor surface of work platform 30 may be configured with a grating made up of parts assembled in the form of a lattice or the like, so that the region below work platform 30 is visible through the floor surface from above work platform 30. The floor surface of work platform 30 may also be configured with a checker plate or the like, so that the region below work platform 30 is invisible through the floor surface from above work platform 30. The floor surface of work platform 30 may be an anti-slip surface.

Work platform 30 has a front edge 30*f*. Front edge 30*f* is an edge located at the front of work platform 30. Front edge 30*f* faces cab 9. A notch in a part affront edge 30*f* of work platform 30 is formed as a notch 33. In the case where the floor surface of work platform 30 is grating, an opening is formed to serve as notch 33, which is larger than the distance between two adjacent parts among the parts constituting the lattice of the grating. As shown in FIG. 3, recess 27 formed at fuel tank 26 and notch 33 formed at work platform 30 overlap each other as seen in plan view. Notch 33 is formed at a position corresponding to recess 27.

Notch 33 is formed in a substantially hexagonal shape or substantially rectangular shape with its two adjacent corners beveled, as seen in the plan view shown in FIG. 3. The perimeter of notch 33 is defined by a pair of edge portions each bent from front edge 30*f* of work platform 30 and extending rearward, two edge portions each extending rearward from one edge portion toward the other edge portion of the pair of edge portions and extending obliquely to the front-rear direction and the right-left direction, and an edge portion connecting respective ends of these two edge portions and extending in the right-left direction.

The shape of notch 33 is not limited to the above example. The perimeter of notch 33 may be defined by a shape which is any combination of flat faces or curved faces, as long as the efficiency of work by a service person on work platform 30 is not deteriorated and a field of view of a service person seeing rearward from cab 9 through notch 33 is ensured.

Since notch 33 is formed, the dimension of work platform 30 in the front-rear direction is smaller in a central portion in the right-left direction. Work platform 30 has a central portion 34, a left portion 37, and a right portion 38. Central portion 34 is provided at a portion of work platform 30 located at the center in the right-left direction of vehicular body 1, left portion 37 is provided at a left portion thereof, and right portion 38 is provided at a right portion thereof. Right portion 38 is located rightward of central portion 34. Left portion 37 is located leftward of central portion 34. Left portion 37 and right portion 38 are coupled to each other via central portion 34.

The dimension in the front-rear direction of central portion 34 is smaller than the dimension in the front-rear direction of left portion 37 and right portion 38. Meanwhile, the dimension in the front-rear direction of central portion 34 is ensured to such an extent that allows a service person to pass central portion 34 by walking. Consequently, a large work space is formed by each of left portion 37 and right portion 38. A service person on left portion 37 or right portion 38 can assume any posture such as standing posture or sitting posture to carry out work.

A handrail 36 is disposed above notch 33. As shown in FIGS. 3 and 4, handrail 36 is constituted of two separate members on the right side and the left side. Handrail 36 has one end fixed to the edge defining notch 33. Handrail 36 extends upward from this one end and curved to extend in the right-left direction. Right and left handrails 36 have respective portions which are each located near the other end which is opposite to the aforementioned one end, and these portions extend substantially linearly in the right-left direction. The other end of right handrail 36 is disposed to face leftward, and the other end of left handrail 36 is disposed to face rightward. The other end of right handrail 36 and the other end of left handrail 36 face each other.

Work platform 30 is supported by a support column 51. The top end of support column 51 is fixed to work platform 30. At the bottom end of support column 51, a fixture portion 52 is provided. Fixture portion 52 is fixed to a vehicular body frame 50 with a plurality of bolts 53. Cab 9 is mounted on vehicular body frame 50 via a damper mount. Work platform 30 is fixed to vehicular body frame 50 via support column 51. Fuel tank 26 is mounted on a rubber mount provided on vehicular body frame 50.

Along the left edge of vehicular body frame 50, an access passage 40 is provided to enable access to work platform 30 from the ground. To access passage 40, a guardrail 41 is attached for preventing unexpected fall.

Figure 5:
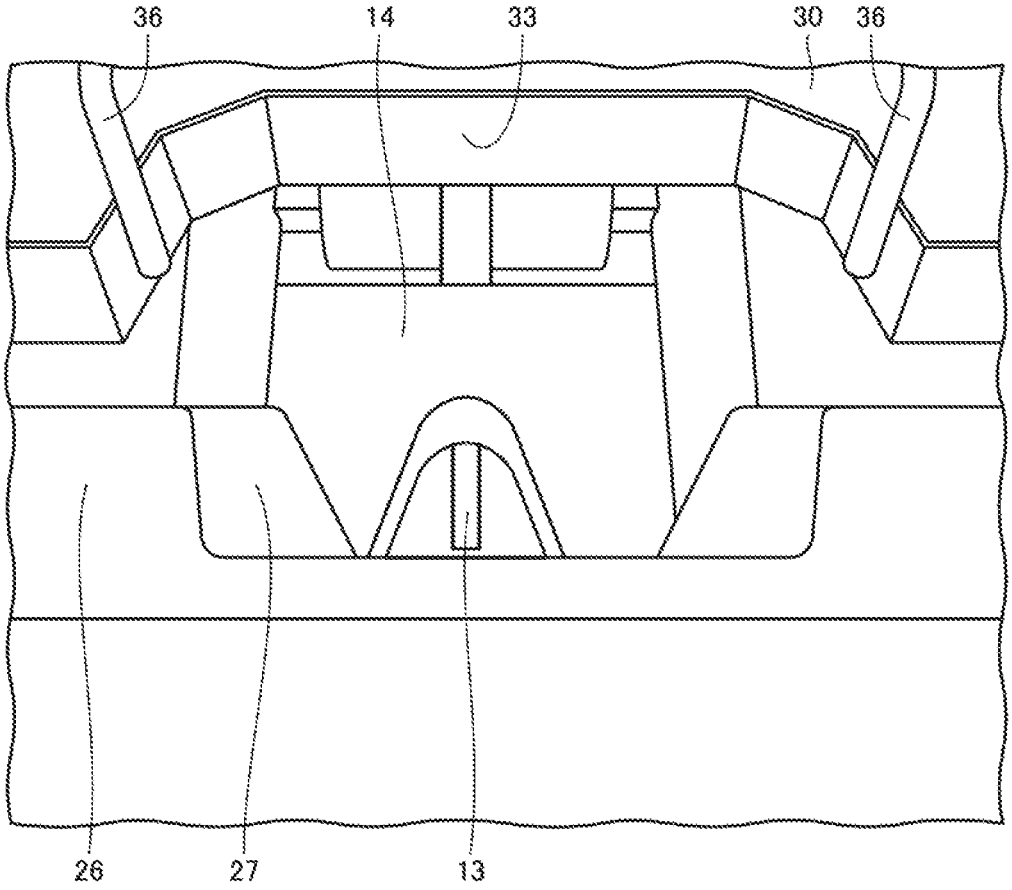
FIG. 5 is a schematic diagram showing a ripping tip as seen through a notch.

FIG. 5 is a schematic diagram showing ripping tip 13 as seen through notch 33. In FIG. 5, an image seen by an operator aboard cab 9 when the operator casts the eyes rearward and downward is schematically shown. Ripping tip 13 is within the field of view of an operator aboard cab 9 when the operator casts the eyes rearward and downward. Since recess 27 is formed at fuel tank 26 and notch 33 is formed at work platform 30, an operator aboard cab 9 can visually recognize ripping tip 13 through a hollow space formed by recess 27 and notch 33, as shown in FIG. 5. The two-dot chain line shown in FIG. 1 virtually indicates a line of sight of an operator aboard cab 9 when the operator casts the eyes rearward and downward.

Since recess 27 is formed, hindering visibility to ripping tip 13, due to fuel tank 26 located between the operator's viewpoint and ripping tip 13, is suppressed. Since notch 33 is formed, hindering visibility to ripping tip 13, due to work platform 30 located between the operator's viewpoint and ripping tip 13, is suppressed.

FIG. 5 shows an image seen when shank 12 is disposed so that ripping tip 13 touches the ground. Lift cylinders 16 may actuate shank 12 to dispose ripping tip 13 at a position away from the ground. An operator aboard cab 9 cannot visually recognize ripping tip 13 located away from the ground. It should be noted that the visual recognition of ripping tip 13 from cab 9 as shown in FIG. 5 is not always possible, and shank 12 may be moved to accordingly locate ripping tip 13 at a position where visual recognition of ripping tip 13 is impossible from cab 9.

Next, functions and effects of the present embodiment will be described.

Bulldozer 10 of the present embodiment includes work platform 30 serving as a scaffold for an operator as shown in FIG. 4. Work platform 30 is disposed above fuel tank 26 disposed rearward of cab 9. A notch in a part of front edge **30*f* of work platform 30 is formed as notch 33**.

Since work platform 30 is provided, the work efficiency when an operator performs work behind cab 9 is improved. An operator aboard cab 9 can see rearward of vehicular body 1 through notch 33 formed at work platform 30. Since notch 33 is formed at work platform 30, a situation where the field of view of an operator aboard cab 9 is blocked by work platform 30 can be avoided. Therefore, the visibility of a rearward region of vehicular body 1 can be improved.

Moreover, as shown in FIG. 4, bulldozer 10 further includes handrail 36 disposed above notch 33. When a worker performs work on work platform 30, the worker can hold handrail 36 as required to make the worker's posture stable. For example, an operator assuming a sitting posture and performing work on work platform 30 can carry out the work while holding handrail 36 in hand. Thus, the work efficiency can be improved.

Moreover, as shown in FIG. 3, a part of fuel tank 26 is recessed from the upper surface to the rear surface of fuel tank 26 to form recess 27. Recess 27 formed at fuel tank 26 and notch 33 formed at work platform 30 overlap each other as seen in plan view. Since notch 33 is provided at a position corresponding to recess 27, an operator aboard cab 9 can visually recognize a broader range through recess 27 and notch 33 as shown in FIG. 5.

Moreover, as shown in FIG. 1, bulldozer 10 further includes ripper device 11 disposed rearward of fuel tank 26. An operator aboard cab 9 can visually recognize ripping tip 13 of ripper device 11 through recess 27 and notch 33 as shown in FIG. 5.

Moreover, as shown in FIG. 4, bulldozer 10 further includes vehicular body frame 50 on which cab 9 is mounted. Work platform 30 is fixed to vehicular body frame 50. While work platform 30 is disposed above fuel tank 26, work platform 30 is not fixed to fuel tank 26. Fuel tank 26 is mounted on vehicular body frame 50 with a rubber mount interposed therebetween. Fuel tank 26 is structured differently from work platform 30 in terms of vibrating system. Work platform 30 can be fixed to vehicular body frame 50 to integrate work platform 30 and vehicular body frame 50 into a single structure, to thereby make the structure of work platform 30 more stable. Thus, the work efficiency on work platform 30 can further be improved.

While the above embodiment has been described regarding the configuration where a part of front edge **30*f* of work platform 30 forms notch 33, the embodiment is not limited to this example. A partial region including front edge 30*f* of work platform 30 may be defined as a front edge portion and notch 33 may be formed in this front edge portion. For example, work platform 30 may have front edge 30*f* extending continuously and linearly from the left end to the right end of work platform 30, and a part of the floor of work platform 30 may be cut to form opening 33 directly rearward of front edge 30***f*.

It should be construed that the embodiments disclosed herein are given by way of illustration in all respects, not by way of limitation. It is intended that the scope of the present invention is defined by claims, not by the description above, and encompasses all modifications and variations equivalent in meaning and scope to the claims.

REFERENCE SIGNS LIST

1 vehicular body; 2 blade; 3 crawler type carrier; 4 frame; 5, 15 tilt cylinder; 6, 16 lift cylinder; 8 engine compartment; 9 cab; 9*c* condenser housing; 10 bulldozer; 11 ripper device; 12 shank; 13 ripping tip; 14 ripper arm; 17 beam; 21 engine; 23 front grille; 26 fuel tank; 27 recess; 30 work platform; 30*f* front edge; 31, 41 guardrail; 32 baseboard; 33 notch; 34 central portion; 36 handrail; 37 left portion; 38 right portion; 40 access passage; 50 vehicular body frame; 51 support column; 52 fixture portion; 53 bolt.

The invention claimed is:

1. A bulldozer comprising:

a cab for an operator to be aboard;

a fuel tank disposed rearward of the cab; and a work platform disposed above the fuel tank and serving as a scaffold for an operator, a notch being formed at a front edge of the work platform, wherein a part of the fuel tank is recessed from an upper surface to a rear surface of the fuel tank to form a recess, and the recess and the notch overlap each other as seen in plan view.

2. The bulldozer according to claim 1, further comprising a handrail disposed above the notch.

3. The bulldozer according to claim 1, further comprising a ripper device disposed rearward of the fuel tank.

4. The bulldozer according to claim 1, further comprising a vehicular body frame on which the cab is mounted, wherein the work platform is fixed to the vehicular body frame.

* * * * *